United States Patent [19]

Patchett et al.

[11] 4,284,312

[45] Aug. 18, 1981

[54] SEALING TYPE ELECTRICAL CONNECTOR

[75] Inventors: David R. Patchett, Milford; Warren J. Phipps, Drayton Plains; Harry Zaverzence, Sterling Heights, all of Mich.

[73] Assignee: Chrysler Corporation, Highland Park, Mich.

[21] Appl. No.: 84,935

[22] Filed: Oct. 15, 1979

Related U.S. Application Data

[63] Continuation of Ser. No. 972,132, Dec. 21, 1978, abandoned.

[51] Int. Cl.[3] ..... H01R 13/52; H01R 13/64

[52] U.S. Cl. ..... 339/60 R; 339/184 R

[58] Field of Search ..... 339/60 R, 60 C, 60 M, 339/59 R, 59 M, 61 R, 61 M, 126 R, 184 R, 211, 217 S

[56] References Cited

U.S. PATENT DOCUMENTS

| | | | |
|---|---|---|---|
| 3,514,741 | 5/1970 | Noren | 339/60 C |
| 3,783,434 | 1/1974 | Ransford | 339/60 C |
| 4,090,759 | 5/1978 | Herrmann, Jr. | 339/60 M |

*Primary Examiner*—Neil Abrams

*Attorney, Agent, or Firm*—Newtson & Dundas

[57] ABSTRACT

A sealing type electrical connector with mating housing portions configured to inhibit undesirable seepage of water or other contaminates into its interior which would be detrimental. A first housing is formed of flexible, molded elastomeric material which is relatively soft. A second housing is molded of rigid thermoplastic material. Each housing includes a tubular outer wall with closed and open ends defining a hollow interior therebetween. The housing members each also include an inner plug portion integrally formed therewith and spaced inward from the tubular outer wall portion, each having electrical contact makers molded therein. The tubular wall of one housing member has an inner diameter slightly larger than the outer diameter of the tubular wall of the other housing member so that the members are assembled with the one member overlying the outer wall of the other member. Circumferentially extended sealing ribs on the member of elastomeric material are engaged by the other member and compressed in the space therebetween to prevent passage of water between the housing members and into the interior.

7 Claims, 9 Drawing Figures

SEALING TYPE ELECTRICAL CONNECTOR

This invention is a continuation of application Ser. No. 972,132 filed Dec. 21, 1978 and now abandoned.

It relates generally to electrical connectors and more specifically to a sealed connector formed by two tubular housing members, a first member overlapping a second in an assembled position. One housing member is molded of soft and flexible elastomeric material while the other member is of relatively rigid and hard thermoplastic material. Compressible means are formed therebetween to effect a seal preventing seepage of moisture into the interior of the connector.

Interfitting connector members having dual housing members overlying one another are known in the art. See for instance U.S. Pat. No. 3,824,524 to Glover issued Jul. 16, 1974 and U.S. Pat. No. 4,010,998 to Tolnar et al which issued Mar. 8, 1977.

As far as we are aware, all electrical connectors of the general type mentioned above utilize a common material for the dual housings or material with very similar properties. Consequently, the dimensions of the dual members had to be sufficient in the vicinity of their overlapping portions so that a considerable gap was formed. Naturally with the aforementioned gap, the connector interior is susceptible to undesirable seepage of water or other contaminates therein. This may induce the metal contacts to corrode and thereby result in an open circuit through the connector.

The primary object of the present invention is to provide a sealed electrical connector including two housing members engaging in overlapping relation to form a substantially sealed interior in which the contact makers are located. Sealing is achieved by utilizing different materials for the housings, one housing being of rigid thermoplastic material, the other housing being of relatively flexible and soft elastomeric material. In addition, soft circumferentially extending sealing ribs between the two members are provided to perfect the seal of the interior.

Another feature which is readily incorporated in the subject connector is the provision of non-circular means to form polarizing means within the interior of the housings so that the connector can be only assembled in one orientation. Similarly, means may be formed on the exterior of the housing members to provide a visual orientation of the connectors for correct assembly.

Other objects and features of the subject invention will become even more readily apparent to those skilled in the art by reading the following detailed description which concerns a preferred embodiment of the invention as illustrated in the accompanying sheets of drawings.

IN THE DRAWINGS

Figure 1:
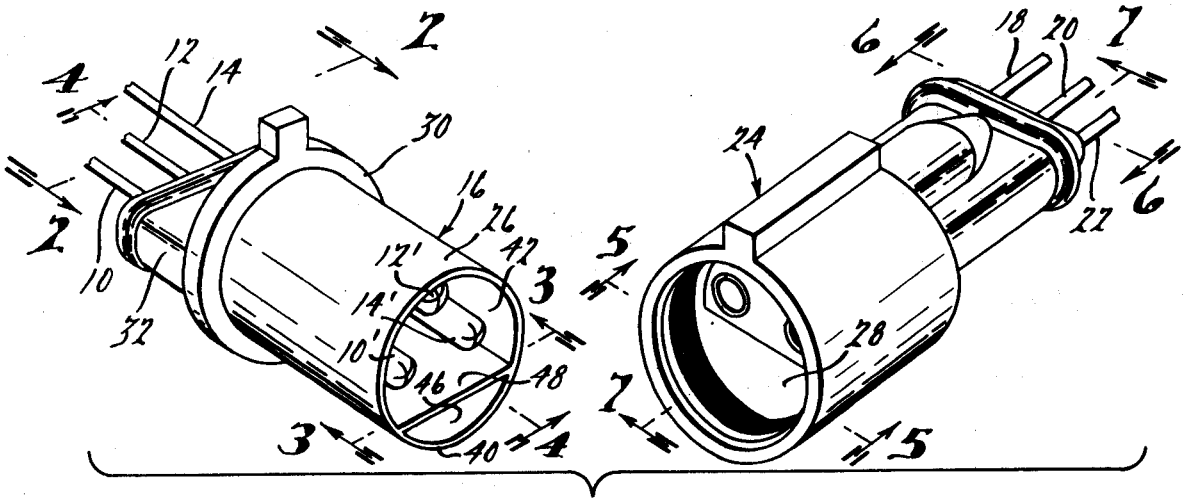
FIG. 1 is a perspective view of the two housing members in an un-assembled mode or orientation.
Figure 9:
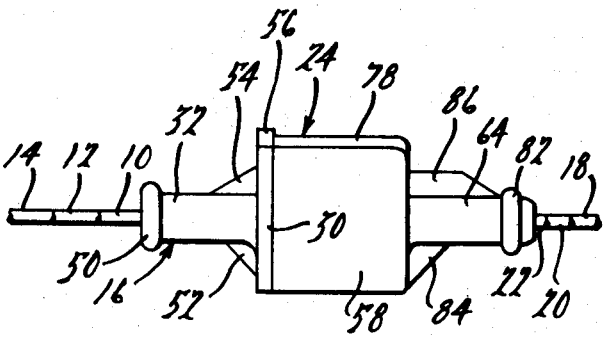

The subject electrical connector is shown in an assembled mode in FIG. 9 and in an unassembled relationship in FIG. 1. The particular connector shown in the drawings is for connecting a three wire set. Wires 10, 12 and 14 extend into first housing member 16. Wires 18, 20 and 22 extend into second housing member 24. Both members 16, 24 are tubular in configuration each having a relatively thick cylindrical wall 26,28 respectively. Both tubular wall portions 26,28 have an open end and a closed end. In the preferred embodiment shown in the drawings, member 16 and specifically the tubular portion 26 thereof has an outer diameter slightly less than the inner diameter of tubular portion 28. Thus the member 16 is adapted to telescope snugly within the member 24 in overlying relationship.

Figure 2:
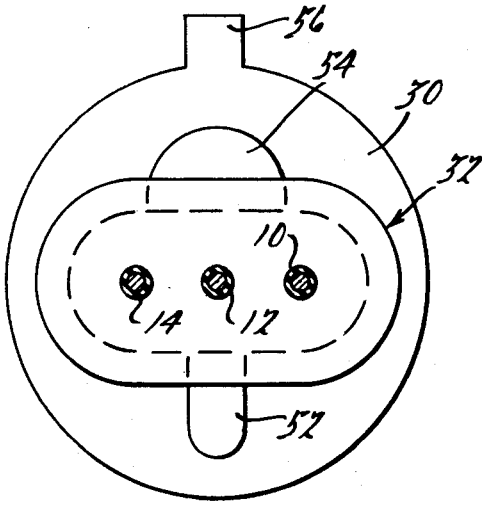
FIG. 2 is a view of the housing member shown on the left in FIG. 1 and taken along view lines 2—2.
Figure 3:
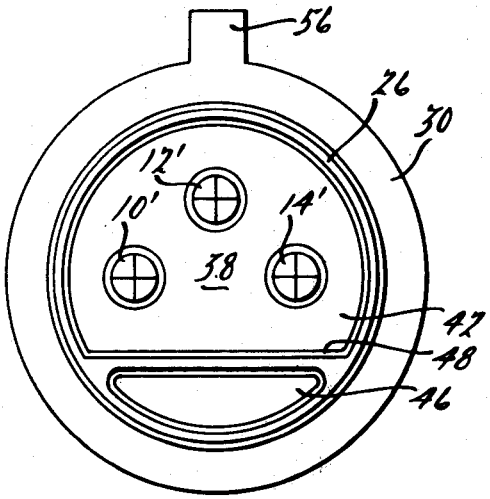
FIG. 3, is another view of the same housing member and taken along view lines 3—3 in FIG. 1.
Figure 4:
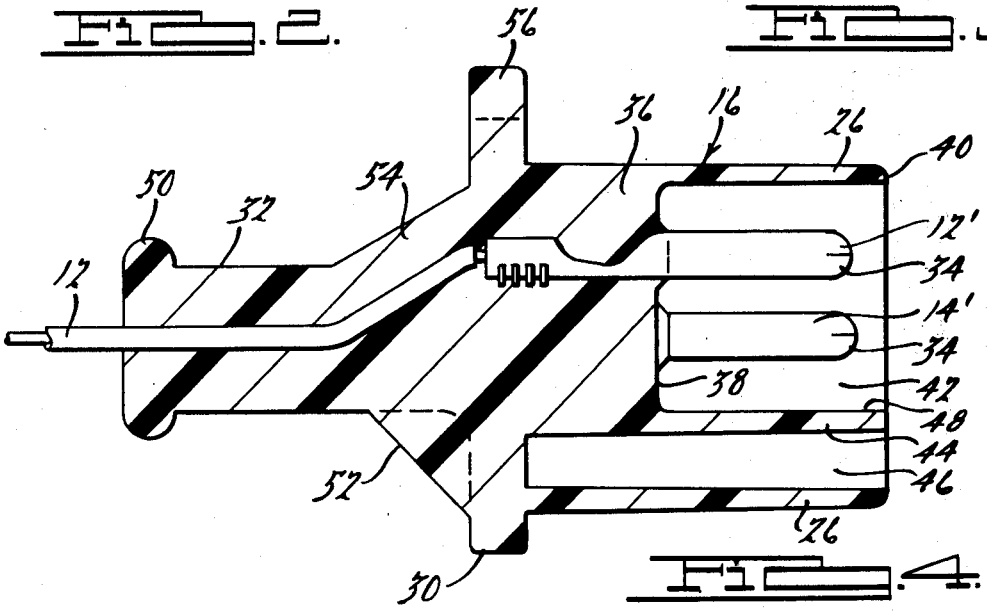
FIG. 4, is an enlarged sectioned view of the same housing member and taken along section line 4—4 in FIG. 1.
Figure 5:
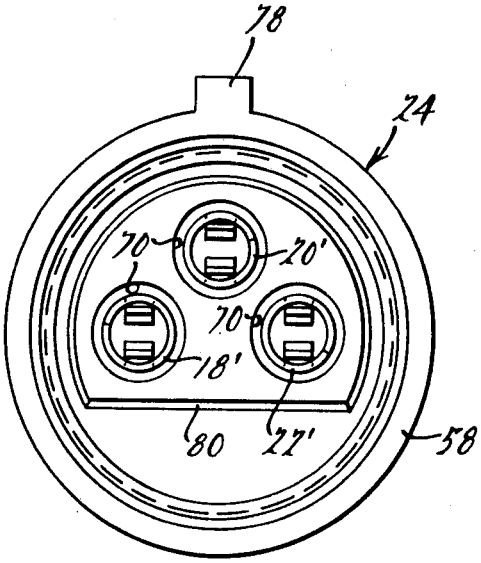
FIG. 5, is a view of the other housing member shown on the right in FIG. 1 and taken along view line 5—5 therein.
Figure 6:
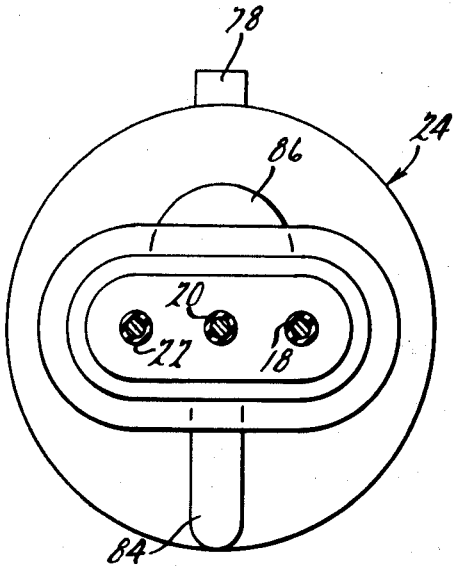
FIG. 6 is a view of the other housing member and taken along view line 6—6 in FIG. 1.

The first housing member 16 and specifically its closed end is formed with an outwardly extending flange portion 30 and a rearward extending grip portion 32 through which the wires 10, 12 and 14 extend. As best shown in FIGS. 2–4, first housing member 16 is mold formed about the wires 10–14. The wires are attached within the member 16 to electrical contacts 10', 12' and 14' as shown in FIG. 4. The electrical contact 10', 12' and 14' are elongated metal members with rounded ends 34. Portions of the contact members are molded within an integral body or plug portion 36 of the member 16. Plug portion 36 has an end face 38 which is inwardly recessed from the open end 40 of tubular portion 26 thus forming an interior space 42. Extending from the plug portion 36 is an interior partition wall which separates the space 42 in which contacts are located and a space 46 extending beneath the plug portion 36. A flat floor 48 of the space 42 is thereby formed the purpose of which will be explained hereinafter.

The grip portion 32 of member 16 is generally oval in cross-section and surrounds wires 10, 12 and 14. Annual bead 50 is formed at the leftward end in FIG. 4. A strengthening rib 52 extends between the grip portion 32 and the flange portion 30. Opposite rib 52, there is provided an enlarged filet portion 54 extending between flange 30 and grip portion 32. The filet 54 is necessitated by the triangular arrangement of the electrical contacts 10', 12' and 14' as shown in FIG. 3 and it provides a uniform thickness of molded material about the wires and particularly wire 12. The only other feature of member 16 heretofore unmentioned is the radially outwardly extending tab portion 56 on flange 30. The purpose of tab 56 will be more readily apparent after the description of member 24 is completed. Also it should be noted and is evident from FIG. 3 that the tubular wall portion 26 and partition member 48 are thicker toward the leftward end in FIG. 4.

Figure 7:
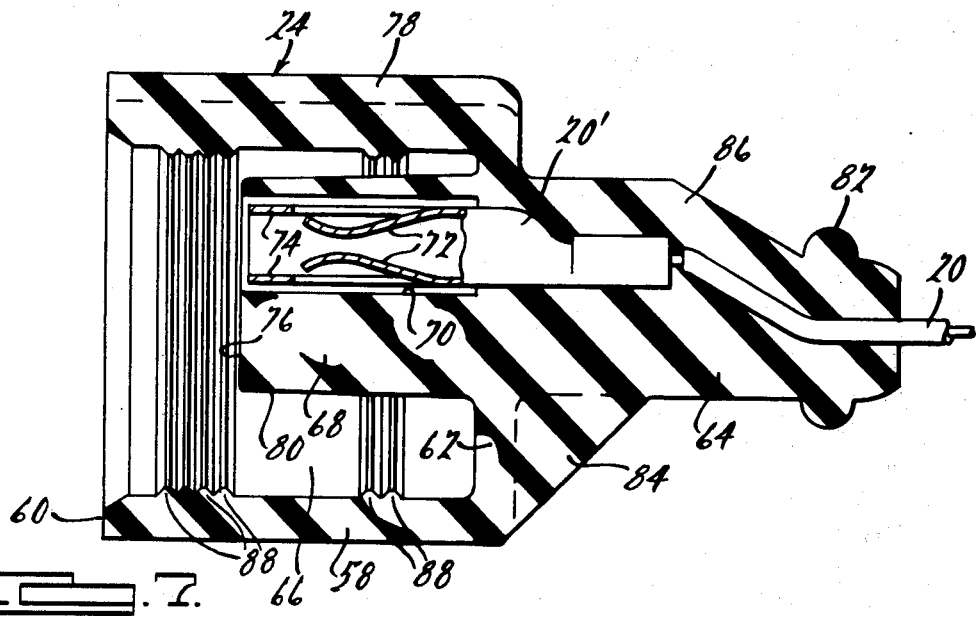
FIG. 7 is an enlarged sectioned view of the other housing member and taken along section line 7—7.

Looking particularly to FIGS. 5, 6, 7 and 8, the second housing member 24 is illustrated. Member 24 is mold formed of an elastomeric material such as PVC and is relatively soft and flexible. Like member 16, member 24 has a tubular configuration formed by an outer tubular wall 58 which terminates at 60 to form an open end. The tubular wall 58 is integrally joined with an end wall 62 and a grip portion 64. Tubular wall 58 encircles an interior space 66 in which an internal plug portion 68 extends integrally from end wall 62. The plug portion 68 is mold formed around end portions of tubular or female type electrical contact receivers 18', 20' and 22'. As shown in FIG. 7, the opposite end portions of the tubular contact receivers extend freely through recessed channels or tunnels 70 formed in the plug portion 68. The tubular contact receivers 18', 20', 22' have particular configuration best shown in FIG. 7. Each includes two diametrically opposed and radially inward finger portions 72 struck from the plane of the tubular wall 74. The plug 68 has an end face 76 adapted to engage the corresponding end face 38 of the member 16 when they are engaged as shown in FIG. 9. An axially extending rib portion 78 on the external surface of the tubular wall 58 is for the purpose of providing visual alignment with the tab 56 on member 16. Further to the same end, the plug portion 68 has a flattened bottom surface 80 which is adapted to engage surface 48 of member 16 when the housing members 16 and 24 are assembled. In the same manner as previously explained with respect to housing member 16, the tubular portion 58 and plug portion 68 are thicker toward the closed end in FIG. 7 and thinner toward the open end. Therefore, the diameter of the interior 66 adjacent the open end 60 is greater than the diameter of interior 66 adjacent the rear end wall 62. This facilitates the assembly of members 16 and 24 and provides for an easy initial slipping engagement between the member 16 and the member 24.

As the members 16 and 24 are assembled by slipping the smaller tubular portion of member 16 into the bore formed by the tubular wall 58, the projecting portions of the contact members 10', 12' and 14' extend into the open end portions of the tubular contact receivers 18', 20' and 22'. After an initial insertion, the rounded ends 34 of the contacts 10', 12' and 14' engage the inwardly extending finger portions 72 of members 18', 20' and 22'. This engagement formed by the finger portion 72 insures that a good electrical contact will be made and maintained between the contacts and the contact receiver members.

The grip portion 64 of member 24 is similar to the grip portion 32 of member 16. An annular bead 82 is formed on its end for a better grasp when it is desirable to separate the members 16 and 24. A reinforcing rib 84 extends between the wall 62 and grip portion 64. As with member 16 an enlarged filet portion 86 extends between the end wall 62 and the grip portion 64 to accommodate the upwardly placed contact receiver 20' as revealed in FIG. 7. If only two contact receivers were used or if the contact receivers were to be placed side by side and in line, the enlarged filet portion 86 could be omitted.

As previously mentioned, both members 16 and 24 have draft angles molded into the tubular wall and plug portions. This tappering provides an easy initial insertion of the tubular portion 26 of member 16 in the bore formed by tubular member 58. Progressively with further insertion of member 16 into member 24, the clearance lessens and eventually becomes an interference fit. The gripping or retaining force increases to better hold the two members together. To prevent seepage of water or other contaminates to the vicinity of faces 38 and 76, four axially spaced and inwardly extending sealing ribs are molded on the surface of the relatively soft member 24. These ribs are located inward from the open end 60 of the tubular portion 58. Further inward but slightly spaced from the end wall portion 62 are two additional rib portions substantially identical to the first set of rib portions. As the tubular portion 26 of member 16 engages the set of four sealing ribs, they are progressively compressed and tend to grip the outer surface of member 16. However as the tubular portion 26 of member 16 is further inserted into the bore of tubular portion 58, the grip increases. Finally when the end of the tubular portion 26 of member 16 passes the second set of sealing ribs, the gripping force approaches a substantial quantity desirable for holding the connector portions 16 and 24 in a permanent relationship. The end 40 of member 16 extends towards the wall 62 but the maximum degree of insertion is limited by engagement between the end faces 38 and 76 of plug portions 36 and 68 respectively. Consequently, the interior space is protected from moisture seepage. Further, the electrical contacts 10', 12' and 14' are protected by their extension into the interior of the tubular contact receivers 18', 20' and 22'. The openings of the recessed channels of tunnels 70 are protected further from moisture seepage by the close fitting engagement between the end faces 28 and 76.

Figure 8:
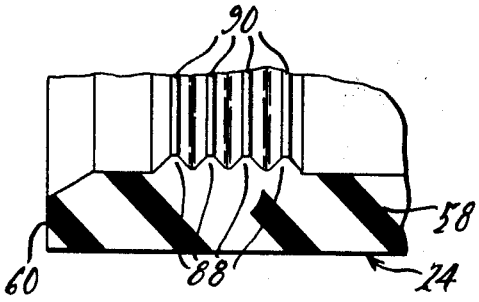
FIG. 8 is an enlarged fragmentary view of the sealing ribs encircled in FIG. 7, and FIG. 9, is an elevational view of the assembled electrical connector.

The specific configuration of the sealing ribs 88 in a preferred embodiment of the subject electrical connector is shown best in FIG. 8. The ribs 88 comprise inwardly extending ridges with a trapezoidal cross-section. This configuration presents a series of narrow annular surfaces 90 which yieldably engage the cylindrical surface of the tubular portion 26 of member 16. The narrow surfaces 90 provides excellent sealing between the member 16 and 24 when compressed and the relatively small contact area provided thereby does not generate excessive engagement and dis-engagement forces.

In the preferred embodiment first used on the Chrysler Horizon and Dodge Omni vehicles in 1978, the rigid housing portion 16 is of rigid plastic material such as nylon but other rigid plastics could be used. The other housing member 24 is made of molded PVC elastomeric material. The latter material has a durometer of about 65 but modifications are possible and material substitutions permissible. Specifically, thermosetting plastic material could be used in place of thermoplastic for member 16. A greater or lesser durometer elastomer could be used as long as distortion (stretching in the preferred embodiment) is possible with manually applied insertion forces.

Although only one preferred embodiment has been illustrated, the subject seal type electrical connector may be subject to some modifications by those skilled in the art without falling outside of the scope of the following claims which solely define the invention.

We claim:

1. A sealing type electrical connector comprising: a soft shell connector housing formed of a molded flexible elastomeric material; a hard shell connector housing formed of a molded rigid plastic material, the housings being configured to allow telescoping interaction together when assembled; each housing including an elongated, tubular walled outer portion closed at one end and open at the other and encircling an interior space, an inner plug portion of integral formation with the tubular walled outer portion radially spaced therefrom and extending axially forwardly from the closed end a distance less than the length of said tubular portion; an electrical contact member molded in the inner plug portion of the first connector housing for engagement with an electrical contact member molded in the inner plug portion of the other connector housing; an electrical conductor for each contact member molded in and extending rearwardly from the closed end of each connector housing; at least one housing being configured with dimensions of the tubular walled portions adapted to facilitate initial ease of insertion of a housing member within the other followed by a progressively greater press fit therebetween as the housings further telescope together toward a fully assembled position with the ends of the plug portions abutting whereby increased insertion causes portions of the soft shell housing to distort; at least one radially extending sealing rib mold formed on the tubular walled portion of the soft shell housing adapted to engage the tubular walled portion of the hard shell housing and be compressed therebetween thereby acting as a barrier to seepage of water into the housing interiors.

2. A sealing type electrical connector comprising: a soft shell connector housing formed of a molded flexible elastomeric material; a hard shell connector housing formed of a molded rigid plastic material, the housing being configured to allow telescoping interaction together when assembled; each housing including an elongated, tubular walled outer portion closed at one end and open at the other and encircling an interior space, an inner plug portion of integral formation with the tubular walled outer portion spaced radially therefrom and extending axially forwardly from the closed end thereof a distance less than the length of said tubular portion, one of the tubular walled portions having an outer dimension at its open end slightly less than the inner dimension of the other tubular walled portion adjacent its open end to facilitate ease of initial insertion; the outer dimension of the one tubular walled portion adjacent its closed end being slightly greater than the inner dimension of the other tubular walled portion adjacent its closed end to produce an interference compression type fit therebetween accompanied by distortion of portions of the soft shell housing; the tubular walled outer portion of said soft shell housing having at least one inwardly extending, axially spaced sealing rib circumferentially formed thereon and located between the tubular walled portions when the housings are telescopingly assembled; an electrical contact member molded in the inner plug portion of the first connector housing for engagement with an electrical contact member molded in the inner plug portion of the other connector housing, and an electrical conductor for each contact member molded in and extending rearwardly from the closed end of each connector housing.

3. A sealing type electrical connector in accordance with claim 1 including two or more selectively releasable electrical contact making means each including a male and a female part and molded respectively in different housings in alignment with one another, associated electrical conductors extending from the contact means to the exterior of each connector housing; polarizing means formed internally of each tubular portion for allowing assembly of the housings in one desired angular orientation and visual alignment means formed externally on each housing correspondingly aligned when the polarizing means are properly oriented for telescoping insertion of one housing member with respect to another.

4. A sealing type electrical connector in accordance with claim 3 wherein said visual alignment means includes a ridge extending longitudinally of one connector housing and an alignment tab adjacent the closed end of the other connector housing.

5. A sealing type connector in accordance with claim 2 in which the tubular walled portion of the hard shell housing is dimensioned to telescope within the tubular walled portion of the soft shell.

6. A sealing type connector in accordance with claim 5 in which polarizing means are employed internally of each tubular walled portion to allow assembly of the housings in only one desired angular orientation; the polarizing means provided on the inner surface of the tubular wall portion of the hard shell housing and on the inner plug portion of the shoft shell housing.

7. A sealed type electrical connector in accordance with claim 6 wherein said tubular walled portions are of cylindrical configuration and the inner plug portion of the soft shell housing is substantially D-shaped in cross section forming a flat thereon and the tubular walled portion of the hard shell housing includes an inner wall extending between portions of its inner surface adapted to be engaged by the flat of the D-shaped plug portion in sliding relation.

* * * * *